US009363604B2

(12) United States Patent
Zha et al.

(10) Patent No.: US 9,363,604 B2
(45) Date of Patent: Jun. 7, 2016

(54) SPEAKER BOX

(75) Inventors: Yu-Bin Zha, Shenzhen (CN); Xiong Zhang, Shenzhen (CN)

(73) Assignees: AAC ACOUSTIC TECHNOLOGIES (SHENZHEN) CO., LTD., Shenzhen (CN); AMERICAN AUDIO COMPONENTS INC., La Verne, CA (US)

( * ) Notice: Subject to any disclaimer, the term of this patent is extended or adjusted under 35 U.S.C. 154(b) by 816 days.

(21) Appl. No.: 13/341,859

(22) Filed: Dec. 30, 2011

(65) Prior Publication Data

US 2012/0170783 A1 Jul. 5, 2012

(30) Foreign Application Priority Data

Jan. 4, 2011 (CN) ..... 2011 2 0000738

(51) Int. Cl.

| | |
|---|---|
| ***H04R 1/02*** | (2006.01) |
| ***H04R 9/02*** | (2006.01) |
| *H04R 9/06* | (2006.01) |

(52) U.S. Cl.

CPC . *H04R 9/025* (2013.01); *H04R 9/06* (2013.01)

(58) Field of Classification Search

CPC ..... H04R 9/025; H04R 9/06; H04R 9/02; H04R 2499/15; H04R 1/025; G06F 1/1605

See application file for complete search history.

(56) References Cited

U.S. PATENT DOCUMENTS

| | | | | |
|---|---|---|---|---|
| 5,909,015 | A * | 6/1999 | Yamamoto et al. | 381/397 |
| 6,925,188 | B1 * | 8/2005 | Markow et al. | 381/306 |
| 2005/0041831 | A1 * | 2/2005 | Stiles et al. | 381/412 |
| 2007/0230737 | A1 * | 10/2007 | Hyde | 381/421 |
| 2007/0237351 | A1 * | 10/2007 | Hyde et al. | 381/397 |
| 2011/0182463 | A1 * | 7/2011 | Lee | 381/412 |
| 2011/0261986 | A1 * | 10/2011 | Murayama | 381/332 |
| 2012/0207338 | A1 * | 8/2012 | Babb | 381/400 |

* cited by examiner

*Primary Examiner* — Duc Nguyen
*Assistant Examiner* — Taunya McCarty
(74) *Attorney, Agent, or Firm* — Anova Law Group, PLLC

(57) ABSTRACT

A speaker box includes a case includes an upper side and a lower side opposite to the upper side, an electroacoustic transducer received in the case and including a first pole plate with a plurality of first gaps for communicating with the magnetic gap, a second pole plate attached on a lower surface of the first pole plate. The second pole plate defines a second main member, a plurality of second auxiliary members extending from a periphery of the first main member, and a plurality of second gaps corresponding to the first gaps. Each of the second auxiliary members defines a longer auxiliary member and a shorter auxiliary member respectively.

7 Claims, 3 Drawing Sheets

SPEAKER BOX

FIELD OF THE INVENTION

The present invention relates to the art of electroacoustic transducers, and more specifically to a speaker box used in a portable device, such as a mobile phone, TV and computer, etc.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of speaker-boxes have been developed. An speaker-box is generally coupled to an audio equipment or an amplifier for use as a large sound producing means for considerably amplifying volume. Alternatively, the speaker-box may be used as a small sound producing means having a small size and volume.

An electronic device, such as a cellular phone, a camcorder, a PDA, a digital camera, or a notebook computer, provides a space for accommodating a speaker-box therein. Nowadays, a speaker-box with high quality audio performance and miniature size is desired.

A related speaker-box comprises a case, a magnetic circuit part having a yoke positioned in the case, a pole plate and a magnet disposed in the yoke, a diaphragm supported by the case, a voice coil directly or indirectly attached to the diaphragm, and a cover pressing on a peripheral portion of the diaphragm. The case and the cover corporately define a cavity. For electrically connecting the speaker-box to an external PCB, a plurality of terminals is provided and is connected to leads of the voice coil. When alternating currents go through the voice coil, the magnet will drive the voice coil to vibrate and the diaphragm will also vibrate with the voice coil accordingly, which converts the currents into sound waves.

However, the performance of such a speaker is not so good because it is not easy to balance the air pressure in the cavity during the vibration of the diaphragm. One related solution for resolving the problem mentioned above is to provide a micro speaker with a magnetic board has a plurality of air gaps. As the amount of the air gaps is increased, the magnetism of the magnetic circuit part is weakened.

So, it is necessary to provide a new speaker box for solving the problem mentioned above.

BRIEF DESCRIPTION OF THE DRAWINGS

Many aspects of the exemplary embodiment can be better understood with reference to the following drawings. The components in the drawings are not necessarily drawn to scale, the emphasis instead being placed upon clearly illustrating the principles of the embodiment.

DETAILED DESCRIPTION OF THE EXEMPLARY EMBODIMENT

Figure 1:
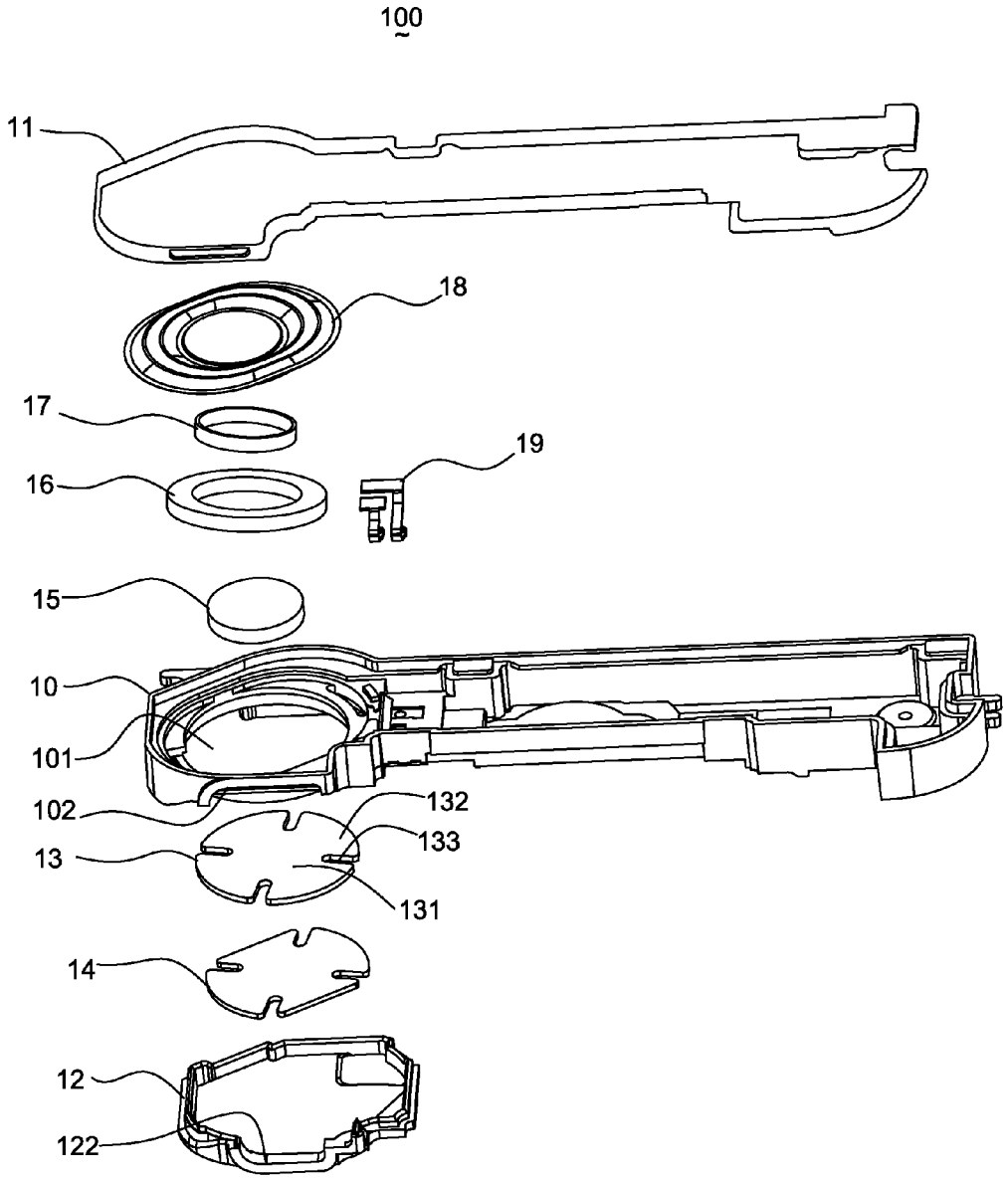
FIG. 1 is an isometric exploded view of a speaker box in accordance with an exemplary embodiment of the present invention.
Figure 2:
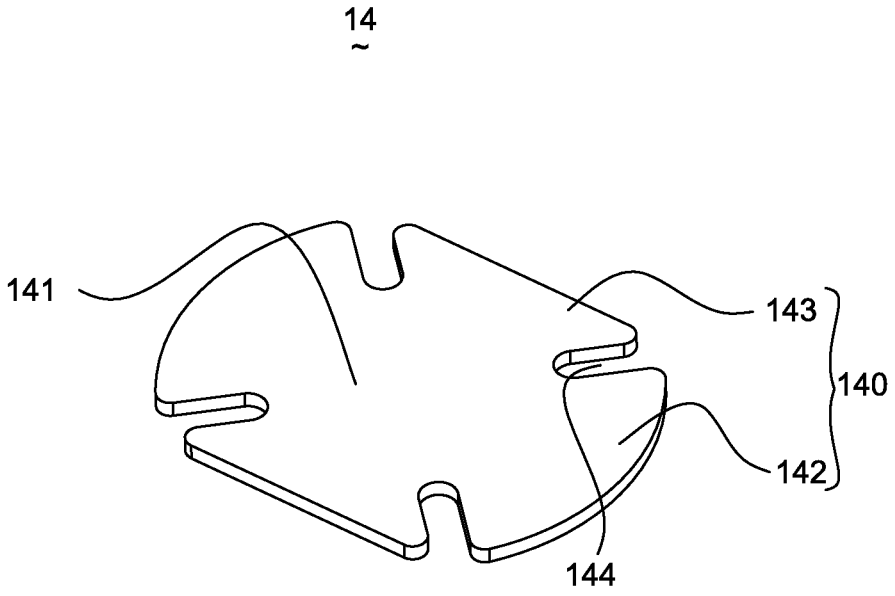
FIG. 2 is an isometric view of a magnetic board of the speaker box.

Reference will now be made to describe the exemplary embodiment of the present invention in detail.

Referring to FIGS. 1 to 4, a speaker box 100 in accordance with an exemplary embodiment of the present invention comprises a case 10 having a receiving cavity 101, a lid 12 coupled with a lower side of the case 10, a cover 11 coupled with an upper side of the case 10, and an electroacoustic transducer received in the receiving cavity 11 of the case 10. The case 10 includes an upper nick 102. The lid 12 includes a lower nick 122 corresponding to the upper nick 102 of the case 10 for forming a window 104 in order to leak sound pressure.

The electroacoustic transducer is used for converting audio electrical signals to audible sounds and includes a magnetic circuit providing a magnetic circuit with a magnetic gap received in the receiving cavity 101, a vibrating device coupled to the case 10 and a pair of connecting members 19. The magnetic circuit includes a first pole plate with a plurality of first gaps. In the present embodiment, the magnetic circuit includes a first pole plate 13, a main magnet 15 positioned at a central portion of the first pole plate 13, a ring magnet 16 positioned at a periphery portion of the first pole plate 13 and surrounding the main magnet 15. The main magnet 15 and the ring magnet 16 are provided with an upper plate attached to top surfaces thereof, respectively. The vibrating device comprises a diaphragm 18 supported by the case and a voice coil 17 directly or indirectly connected to the diaphragm 18. The voice coil 17 suspended in a magnetic gap formed between the main magnet 15 and the ring magnet 16.

The electroacoustic transducer further includes a second pole plate 14 positioned on a lower surface of the first pole plate 13. The first pole plate 13 includes a first main member 131 and a plurality of first auxiliary members 132 extending from a periphery of the first main member 131, and a first gap 133 is formed between two adjacent first auxiliary members 132. The first gap 133 communicates with the magnetic gap. Similarly, the second pole plate 14 includes a second main member 141 and a plurality of second auxiliary members 140 extending from a periphery of the first main member 141. In the present embodiment, four first auxiliary members 132 are provided extending from the first main member 131. The second auxiliary members 140 defines a longer auxiliary member 142 and a shorter auxiliary member 143 respectively extending forming the second main member 141. A second gap 144 is formed between the longer auxiliary member 142 and the shorter auxiliary member 143 for at least partially aligning with the first gap 133. In other words, each of the longer auxiliary members 142 forms a second gap 144 corporately with an adjacent shorter auxiliary member 143. Four second gaps 144 are provided to surround the second main member 131. Furthermore, especially referring to FIG. 3, a distance R1 from at any point of the edge of longer auxiliary member 142 to a center point of the second main member 141 is greater than a distance R2 from at any point of the edge of shorter auxiliary member 143 to the center point of the second main member 141.

Figure 3:
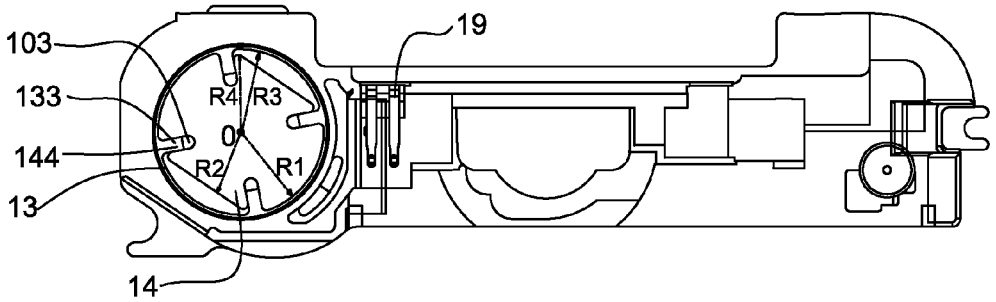
FIG. 3 is a back view of the speaker box in FIG. 1, with a lid thereof being removed away.
Figure 4:
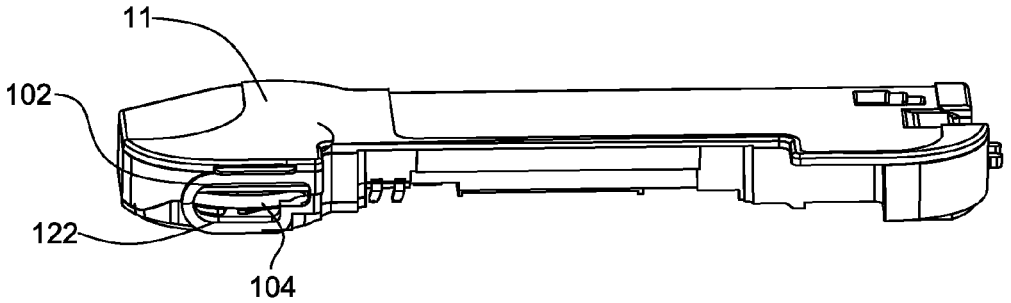
FIG. 4 is an isometric assembled view of the speaker box shown in FIG. 1.

Referring to FIG. 3, in the present exemplary embodiment, the second pole plate 14 has a common center O with the first pole plate 13. A distance R3 from at any point of the edge of first pole plate 13 to the common center O is greater than a distance R4 from at any point of the edge of shorter auxiliary member 143 to the common center O. The second gap 144 and the first gap 133 are made to at least partially lap over each other and form a through hole 103 communicating with the magnetic gap.

While the voice coil is used in a transducer having a diaphragm, the connecting member of the voice coil is connected to the diaphragm. When the diaphragm vibrates, the air below the diaphragm will be compressed and then leaks to the window 104 via the through hole 103, which balances the air pressures between the air below the diaphragm and the air out of the diaphragm. Meanwhile, the magnetism of magnetic circuit part is enhanced.

While the present invention has been described with reference to a specific embodiment, the description of the invention is illustrative and is not to be construed as limiting the invention. Various of modifications to the present invention can be made to the preferred embodiment by those skilled in the art without departing from the true spirit and scope of the invention as defined by the appended claims.

What is claimed is:

1. A speaker box, comprising:

a case having a receiving cavity;

an electroacoustic transducer received in the receiving cavity and including a magnetic circuit with a magnetic gap, a diaphragm and a voice coil connected to the diaphragm, the voice coil at least partially inserted in the magnetic gap;

the magnetic circuit including a first pole plate, a main magnet mounted on a central portion of the first pole plate, a ring magnet mounted on a periphery portion of the first pole plate and surrounding the main magnet forming the magnetic gap between the main magnet and the ring magnet;

the first pole plate including a first main member and a plurality of first auxiliary members extending from a periphery of the first main member, and a first gap being formed between two adjacent first auxiliary members;

a second pole plate concentrically attached on a lower surface of the first pole plate, the second pole plate including a second main member and a plurality of second auxiliary members extending from a periphery of the second main member, and a second gap being formed between two adjacent second auxiliary members, wherein the first main member of the first pole plate and the second main member of the second pole plate are centered together at a common center point, wherein the second gap at least partially laps over or aligns with the first gap, the second gap communicating with the first gap for communicating with external air; and the ring magnet and the first pole plate corporately forming a hole communicating the magnetic gap with the first gap of the first pole plate for leaking the air pressure of the magnetic gap.

2. The speaker box as described in claim 1, wherein the second auxiliary members include a longer auxiliary member and a shorter auxiliary member respectively extending from the second main member, and the second gap formed between the longer auxiliary member and one adjacent shorter auxiliary member.

3. The speaker box as described in claim 2, wherein a distance from any point of the edge of the longer auxiliary member to the common center point of the second main member is greater than a distance from any point of the edge of the shorter auxiliary member to the common center point of the second main member.

4. The speaker box as described in claim 3, wherein a distance from any point of the edge of the first pole plate to the common center point is greater than a distance from any point of the edge of the shorter auxiliary member to the common center point.

5. The speaker box as described in claim 4, wherein the first pole plate includes four first gaps, the second pole plate includes four second gaps corresponding to the four first gaps.

6. The speaker box as described in claim 4 further comprising a lid coupled with a lower side of the case, and a cover coupled with an upper side of the case.

7. The speaker box as described in claim 4 further comprising a lid coupled with a lower side of the case forming a window for communicating with the hole, and a cover coupled with an upper side of the case.

* * * * *